US006382105B1

(12) United States Patent
Jones

(10) Patent No.: US 6,382,105 B1
(45) Date of Patent: May 7, 2002

(54) AGENT DEFEAT WARHEAD DEVICE

(75) Inventor: John W. Jones, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/794,051

(22) Filed: Feb. 28, 2001

(51) Int. Cl.[7] ..... F42B 15/00
(52) U.S. Cl. ..... 102/370; 102/372; 102/373
(58) Field of Search ..... 102/370, 372, 102/373

(56) References Cited

U.S. PATENT DOCUMENTS

| | | | | | |
|---|---|---|---|---|---|
| 1,295,569 | A | * | 2/1919 | Murray, Jr. | 102/372 |
| 3,143,070 | A | | 8/1964 | Bowen | 102/66 |
| 3,332,348 | A | | 7/1967 | Myers et al. | 102/6 |
| 3,382,800 | A | | 5/1968 | Biggs, Jr. | 102/6 |
| 3,498,218 | A | | 3/1970 | Myers | 102/6 |
| 3,596,602 | A | | 8/1971 | Gey et al. | 102/90 |
| 3,661,083 | A | | 5/1972 | Weimholt | 102/6 |
| 3,707,918 | A | | 1/1973 | Dunfee et al. | 102/90 |
| 3,712,219 | A | | 1/1973 | Blair et al. | 102/6 |
| 3,831,520 | A | | 8/1974 | Bowen et al. | 102/7.2 |
| 3,951,037 | A | * | 4/1976 | Bornand | 102/373 X |
| 4,044,684 | A | * | 8/1977 | Gaggini et al. | 102/370 |
| 4,324,183 | A | * | 4/1982 | Prahauser et al. | 102/370 |
| 4,505,200 | A | * | 3/1985 | Bush | 102/370 X |
| 4,651,648 | A | | 3/1987 | Alon | 102/387 |
| 4,667,601 | A | * | 5/1987 | Diamond et al. | 102/370 X |
| 4,699,061 | A | * | 10/1987 | Jeffers | 102/370 |
| 4,798,143 | A | | 1/1989 | Graham | 102/370 |
| 4,967,636 | A | | 11/1990 | Murray et al. | 102/370 X |
| 5,101,730 | A | * | 4/1992 | Bender et al. | 102/373 X |
| 6,250,226 | B1 | * | 6/2001 | Liechter et al. | 102/370 |

* cited by examiner

*Primary Examiner*—Peter A. Nelson
(74) *Attorney, Agent, or Firm*—Burns, Doane, Swecker & Mathis, LLP

(57) ABSTRACT

A high mass flow pyrotechnic gas generator in the aft end of a hard target penetrating warhead generates hot gases during penetration into a chemical or biological manufacturing or storage facility. This device will act to place neutralizing gases in and near the entry hole made in the target where viable infectious agents are most likely to be dispersed early in the warhead event before the operation of the main warhead charge. The gas generating material, which may be similar to a composite solid propellant, will produce very hot gases preferably containing hydrogen chloride and vapor phase moisture or other chemical sanitizing material. The combination acts as a neutralizer to render chemical and/or biological agents inert. The neutralizer will mix with the chemical and/or biological agents during the initial surge of aerosolized chemical and/or biological agents released in the target and render them harmless.

20 Claims, 6 Drawing Sheets

AGENT DEFEAT WARHEAD DEVICE

BACKGROUND OF THE INVENTION

1. Field of the Invention

The present invention is directed to ordnance. More particularly, the present invention is directed toward bombs and warheads that may be carried by airplanes or in missiles, loaded with a payload. The payload may comprise a chemical and/or biological defeating lethal system.

2. State of the Art

In the discussion of the state of the art that follows, reference is made to certain structures and/or methods. However, the following references should not be construed as an admission that these structures and/or methods constitute prior art. Applicant expressly reserves the right to demonstrate that such structures and/or methods do not qualify as prior art against the present invention.

In the course of waging an armed campaign, one needs to destroy and/or otherwise render useless to the enemy his resources to continue such campaign. Ordnance has been developed to efficiently accomplish this task including warheads, bombs, projectiles, explosives, or other means. A typical warhead configuration includes a hard casing which carries a payload material. The hard casing often includes a substantially elongated cylindrical body with an ogive shaped nose section. Such warheads can be deployed by cruise or ballistic missiles or by release from an aircraft, but are not limited to such deployment.

One critical need has been to destroy resources housed within structures fortified by burial, concrete, rock, steel or other hardened materials. One type of ordnance designed to defeat such resources is commonly known as a hard target penetrating warhead. A hard target penetrating warhead is designed to penetrate a hardened structural defense and deliver a main explosive payload to the interior of the structure. Examples of such current conventional warheads are the BLU-109, BLU-113, BLU-116, the JASSM-1000, the J-1000 and the JAST-1000 warheads.

The widespread dissemination of weapons of mass destruction based on chemical or biological agents has compounded the difficulty in targeting and successfully destroying hardened targets that contain such chemical or biological agents. The following offers a perspective to the urgency of the need to suppress collateral damage caused by the escape of biological agents from a storage bunker attacked by a conventional hard target penetrating warhead.

Live or viable biological and/or chemical agents in the dry or wet states or liquid may be aerosolized by impact of the warhead inside the bunker and expelled to the atmosphere through the warhead entrance hole, a problem that may be exacerbated by operation of an explosive warhead. Biological warfare agents such as Anthrax mixed with an anti-agglomerate could easily have a spore count of $10_9$ spores per gram of agent. If 100 kilograms of agent were stored in facilities such as those discussed (e.g., hardened bunkers), then 100 grams of viable agent could be found in an ejected cloud caused by detonation of the main payload of a hard target penetrating warhead inside the bunker. That is to say nearly $10_{11}$ spores would be released to the atmosphere. If it is assumed that $10^4$ spores per gram constitute a lethal human dose (approximating the accepted value of 8,000 spores being lethal to 50% of the exposed population), then this scenario suggests that the ejected cloud could cause 5,000,000 deaths. For this reason, the ejected cloud retains its lethal character for many tens of kilometers as it is transported downwind.

Therefore, there is a need not addressed in the prior art to neutralize dangerous chemical and biological agents inside targets, in the vicinity of targets, and during expulsion from the targets which are attacked by a hard target penetrating warhead.

The prior art in this field generally speaks to the delivery of active biological and/or chemical agents to the enemy and not to the delivery of neutralizing agents. U.S. Pat. No. 3,831,520 to Bowen et al., U.S. Pat. No. 3,661,083 to Weimholt and U.S. Pat. No. 3,596,602 to Gey et al. are representative of such devices.

In U.S. Pat. No. 3,143,070 to Bowen, the incorporation of a neutralizing agent into a safe biological or chemical projectile is discussed. The neutralizing agent is designed to allow for the safe handling of the projectile and to be "blown off" before a second noxious agent is deployed. The neutralizing agent is utilized as an internal safety feature and is not conceived, nor can it be used, to deliver a neutralizing agent to a hard target. In other respects, this device acts to dispense toxic or poisonous aerosols in the free air above the surface of the target upon contact with the target.

BRIEF SUMMARY OF THE INVENTION

Prior practices known in the state of the art do not address the problem of the release of dangerous agents during impact of a warhead into a target. The present invention utilizes a very high mass flow gas generator device incorporated into a hard target penetrating warhead that releases hot, sterilizing gases while penetrating hardened targets and functions both while penetrating the target's protection and continues to function inside the target and, as so described, the proposed invention adds a key functionality to a hard target penetrating warhead that carries explosives, incendiaries or neutralizers as a separate main payload.

The present invention comprises a gas generating assembly which houses a gas generant which produces a sterilizing gas. An igniter is positioned so as to initiate combustion of the gas generant upon impact on the exterior of the target and which may further cause activation of the main weapon payload. The construction of the warhead and the agent defeat warhead device includes venting ports for the release of the gases which are the combustion product of the gas generating assembly.

BRIEF DESCRIPTION OF THE DRAWING FIGURES

The objects and advantages of the invention will become apparent from the following detailed description of preferred embodiments thereof in connection with the accompanying drawings in which like numerals designate like elements and in which.

DETAILED DESCRIPTION OF THE INVENTION

The concept of operation of an agent defeating warhead device is for deployment in conjunction with a hard target penetrating warhead against hardened targets containing biological and/or chemical warfare agents ("CB agents"). The warhead desirably functions such that a hot, chemically corrosive kill environment is created by the release of neutralizing combustion products from the agent defeat warhead device and the incendiary action of the main payload of the hard target penetrating warhead. Exploding submunitions may be deployed from the bomb inside the target for disruption of apparatus or storage containers or weapons containing CB agents. While the primary objective of the agent defeat warhead device is destruction of the contents of a target and neutralization of CB agents in the target, an equally important objective is prevention of escape of aerosolized CB agents to the atmosphere through a hole made by the warhead in penetrating the target. In a target room densely packed with, for example, containerized dry, wet or liquid CB agent(s) the warhead predictably will impact containers of CB agent causing the contents to be aerosolized and dispersed. Thus, the possibility of venting viable CB agent to the atmosphere prior to main payload operation is unacceptably high. The concept of placing a high mass flow gas generator in a warhead to function during entry into the target room was conceived as a means for generation of a kill environment at and inside the entry hole made by the warhead. CB agent released during impact of the hard target penetrating warhead, and before action of the main payload inside a bunker, would therefore be subjected to mixing with the combustion products of the agent defeat warhead device during expulsion from the target and thereby subjected to an appropriate neutralizing environment.

The concepts described herein can advantageously be adapted to existing warhead configurations.

In the following description, features which are common among the different embodiments have been identified by the same reference numbers.

A device 20 is substantially a high mass flow gas generator for generating combustion products that neutralize chemical and/or biological agents and places neutralizing combustion products in, outside and within the hole in the target made by a hard target penetrating warhead 10.

Figure 1:
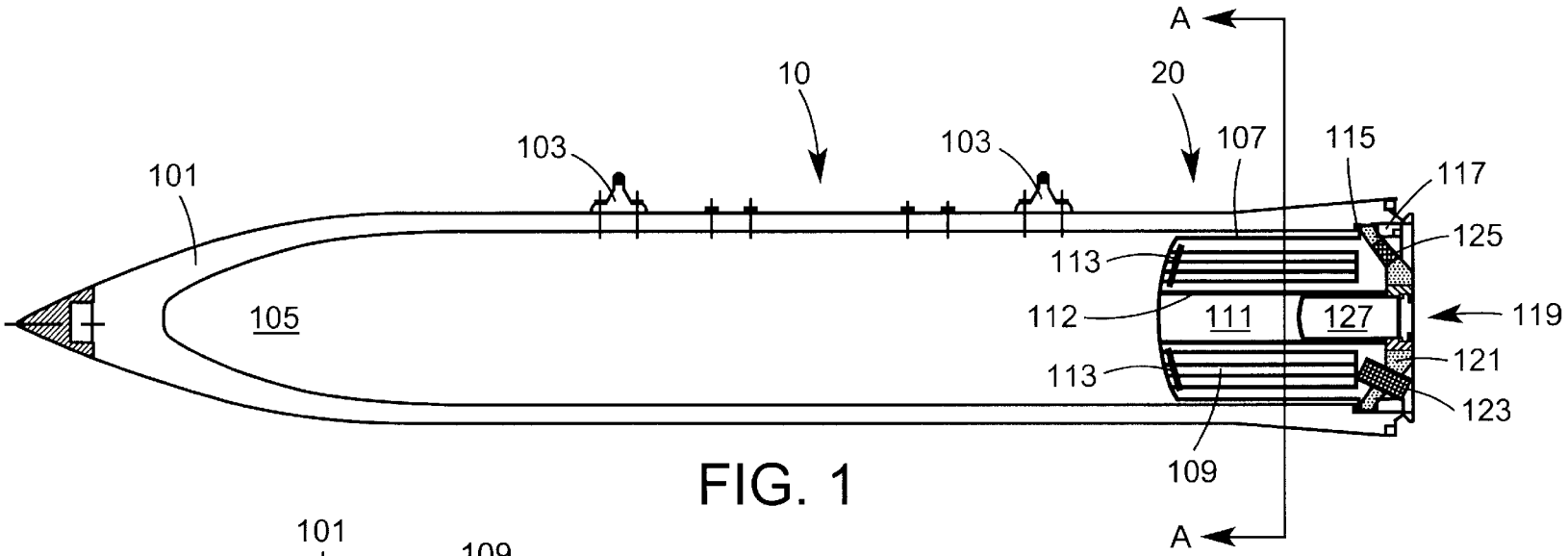
FIG. 1 is a longitudinal cross-sectional view of a warhead showing an agent defeat warhead device according to a first embodiment.

The device 20 is preferably placed in the aft end of a hard target penetrating warhead 10 with only minor modifications to a basic warhead casing 101 as shown in FIG. 1. As previously noted, an important advantage of the present invention is the ability to utilize existing warhead configurations which can be adapted, without major modification, to incorporate the device 20 of the present invention. Examples of such current warheads are BLU-109, BLU-109/B, BLU-113, BLU-116, JASSM-1000, J-1000, and the JAST-1000. An unspecified main payload operating after target penetration can be contained within a payload area 105. The warhead casing 101 is depicted with bomb rack attachment lugs 103 for attachment to an aircraft bomb rack.

In one embodiment of the invention, the device 20 comprises a gas generator pressure vessel 107 interior to a warhead casing 101 and clamped into the aft end of the warhead casing 101 by virtue of a mating lip 115 on the aft end of the pressure vessel 107, which is retained in a bomb by a warhead aft closure 119 which is clamped strongly onto the aft end of the warhead casing 101 by a screwed in retaining ring 117. The device gas generator pressure vessel 107 is formed in the shape of a cylindrical annulus, i.e. the generally cylindrical gas generator pressure vessel has a hole through its centerline 111 and a cylindrical steel inner shell 112. The gas generator pressure vessel 107 is attached to the warhead aft closure 119 by a gas generating assembly threaded attachment 121. The inner shell 112 contains, at the rightmost or aft end, a space for installation of a main payload fuze 127 at a location suitable for igniting of a main payload. In this embodiment, the bomb fuze 127 acts upon the main payload through the passage formed by the inner wall of the annular pressure vessel 112. The passage formed by the inner wall of the annular pressure vessel 112 may also serve as a conduit for other bomb or payload related apparatus.

Figure 4:
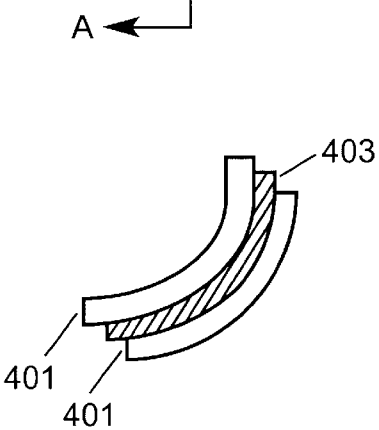
FIG. 4 is a schematic illustration of a gas generating assembly.
Figure 2:
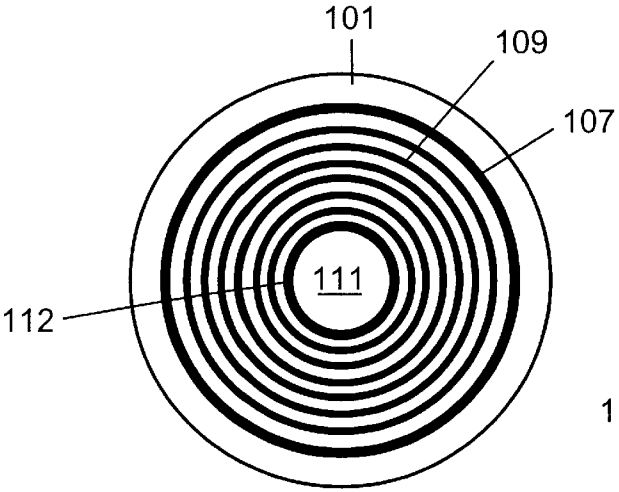
FIG. 2 is a cross section of the warhead of FIG. 1 taken at A—A.

Inside the hollow annulus of the gas generator pressure vessel 107, a gas generating assembly 109 is disposed. In FIG. 2, a cross-section of the device 20, taken at A—A, is shown at enlarged scale for clarity. The gas generating assembly 109 is shown as an assemblage of circular elements disposed concentrically in the annular volume of the gas generator pressure vessel 107. As shown in FIG. 4, each annular ring includes two thin layers of gas generator charge 401 bonded to a gas generator support layer 403. The support layer 403 may comprise any suitable material, such as a thin metallic sheet. The purpose of the gas generating support layer 403 is to provide mechanical strength to the gas generating assembly 109, to resist distortion of the assembly during warhead impact on a target, and to resist the tendency of the gas generator gases to draw the gas generator charge 401 out of place during combustion. At the left or forward end of the gas generating assembly 109, the gas generator support layer 403 is bonded or "potted" by adhesive to attach the gas generating assembly 109 to its gas generator pressure vessel 107 at a gas generator assembly attachment point 113.

The gas generator charge 401 is rapidly ignited by a suitable flash/pyrogen igniter 123 upon impact of the warhead with the target exterior so as to begin the production of gaseous species by the device 20 while the hard target penetrating warhead 10 traverses into and through protective alluvium, rock and wall and into a target. The objective is to release as large a quantity of combustion gas as possible in the entry hole in the target wall or roof made by the penetrator as well as just inside and outside the wall of the target room. The initial pressurization of the device 20 is controlled by the energy of the flash/pyrogen igniter 123 and by burst disk plugs 125 placed in holes through the warhead aft closure 119. The intent of the design is to obtain an operating pressure of approximately 5,000 to 10,000 pounds per square inch before the burst disk plugs 125 are ejected, allowing neutralizing gas to escape through the holes. The number and size of the holes may be varied to control the operating characteristics of the gas generating assembly 109.

Figure 3:
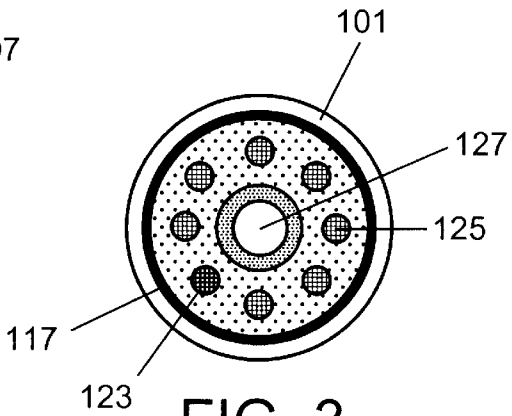
FIG. 3 is an aft view of FIG. 1.

FIG. 3 depicts one embodiment of the number and location of burst disk plugs 125 arranged on the warhead aft closure 119. Once the burst disk plugs 125 are ejected, the gas generator charge 401 will burn rapidly at a pressure determined by the ratio of the area of burning gas generator charge to the area of the vent holes, the "port to throat" area. Owing to the intentional design of the gas generator charge for a high Kn (which is approximately the length of the grain divided by spacing between elements of the charge), the mass flow through the holes will be enhanced by "erosive" burning. In general, the design of the device 20 is to favor extremely high mass flow rates of combustion products during a total operation time for the device 20 of approximately 10 to 100 milliseconds, namely during the time period when the gases from the gas generating assembly 109 can be exhausted during travel of the hard target penetrating warhead 10 into and just beyond the inside wall/ceiling of the target. This sequencing puts the exhaust gases where they can most effectively neutralize toxic or infectious contents of the target which have been stirred up and aerosolized by impact of the hard target penetrating warhead.

Figure 5:
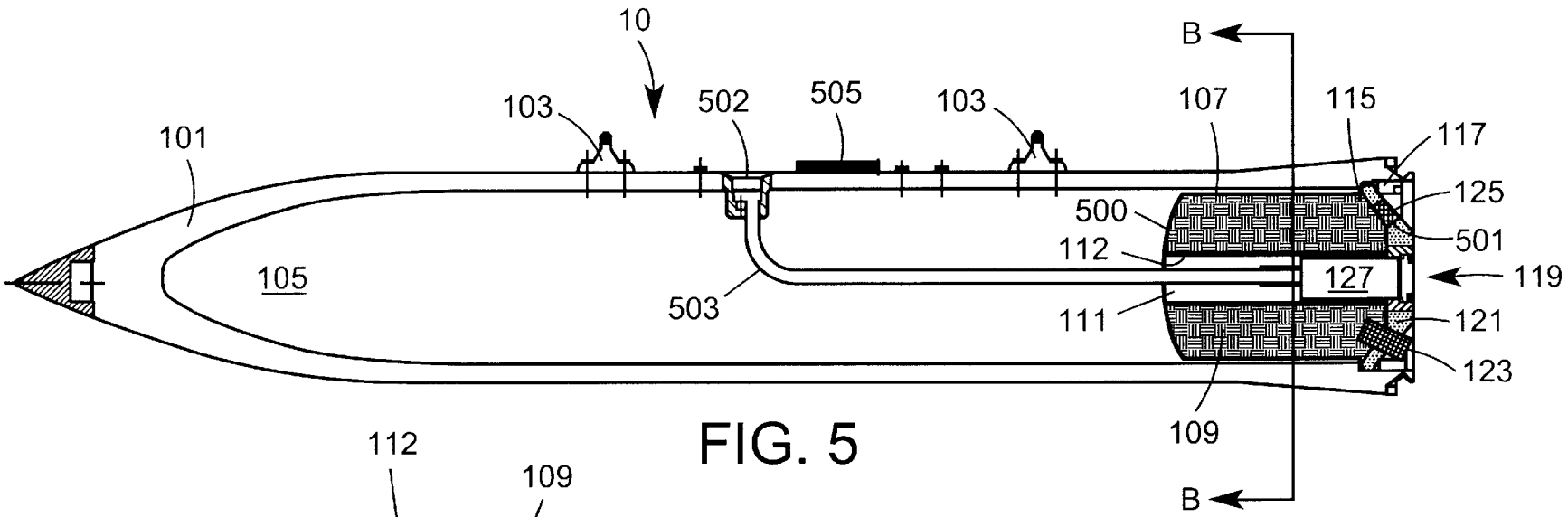
FIG. 5 is a longitudinal cross-sectional view of a warhead according to another embodiment of the invention.
Figure 7:
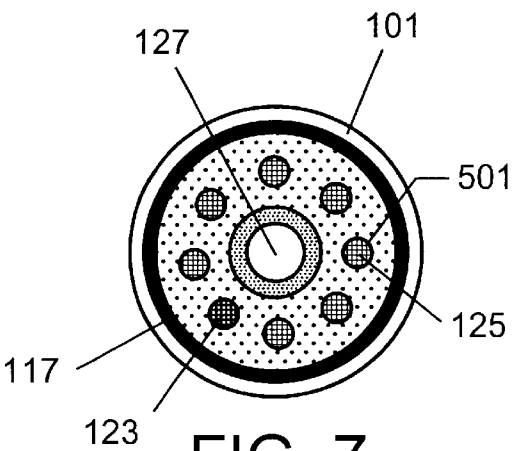
FIG. 7 is an aft view of FIG. 5.
Figure 6:
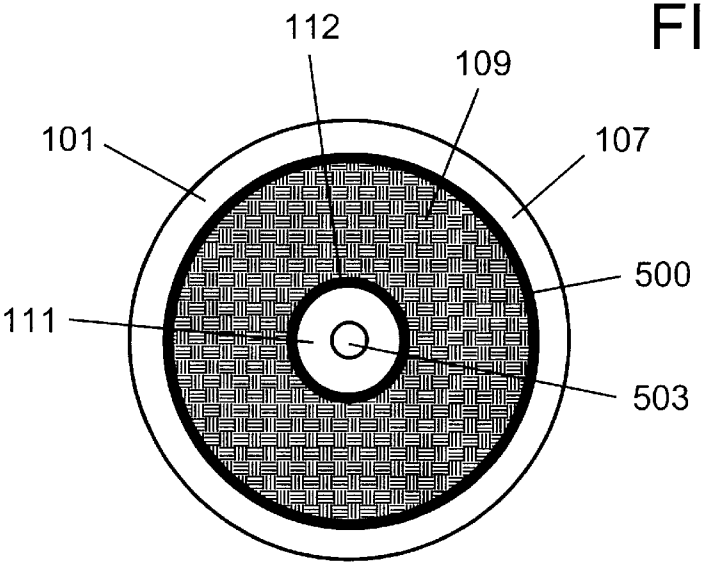
FIG. 6 is a cross section of the warhead of FIG. 5 at B—B.

A second embodiment of the invention is shown in FIG. 5. This concept differs from the previous description in that the gas generating assembly 109 is comprised of a pelletized gas generator charge 500 in which each pellet combusts separately. The charge of pellets is similar to the gun propellant charges used in propelling artillery projectiles through a gun tube. The pellets are constrained to burn mostly inside the gas generator pressure vessel 107 by installation of restraints 501, such as strong grids or grates or traps, that keep the pelletized gas generator charge 500 inside the chamber after ejection of the burst disk plugs 125 and while combustion occurs.

FIG. 5 depicts an embodiment of the invention in which a device 20 comprising a gas generator pressure vessel is disposed in a typical hard target penetrating warhead 10. In FIG. 5, the placement of a FZU well 502, a charging tube 503, and a "bombs away" switch 505 that is compatible with the device 20 described herein, is shown.

The first two embodiments have incorporated a dedicated gas generator pressure vessel 107 in which was disposed a gas generating assembly 109. Alternately, the separate gas generator pressure vessel 107 may be eliminated from the design.

Figure 8:
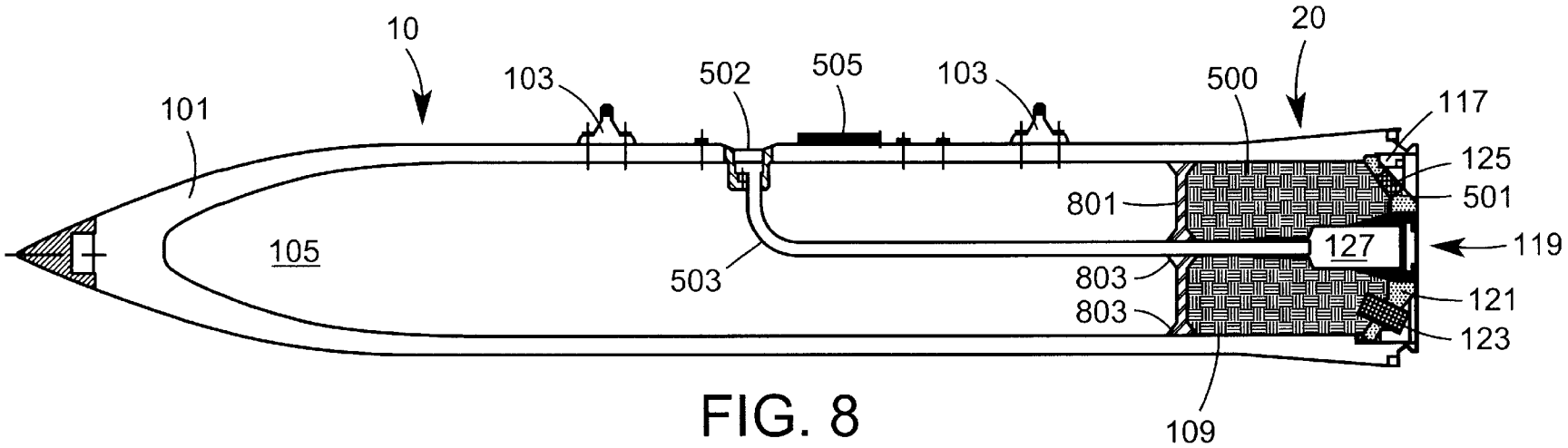
FIG. 8 is a longitudinal cross-sectional view of a warhead according to yet another embodiment of the invention.
Figure 9:
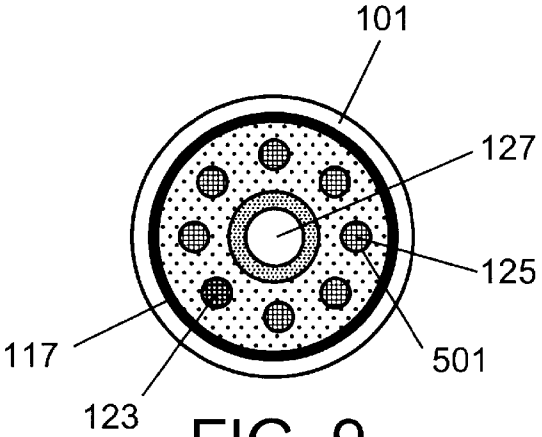
FIG. 9 is an aft view of FIG. 8.

FIG. 8 depicts this embodiment in which a device 20 comprises a barrier 801 with compliant gas seals 803 separating the gas generating assembly 109 and the main payload area 105. The barrier 801 is designed to fit compliantly against the contents of the main payload area 105 and allows the pressure developed in the device 20 during its operation to be exerted against the contents. The compliant gas seal 803 may be a compliant elastomeric insulation material, such as EPDM rubber, or a metal plate encapsulated in rubber-like material. The compliant gas seals 803 are located where the barrier 801 meets the warhead casing 101 and at any through members, such as a charging tube 503. In its other functional aspects, the device 20 of this embodiment functions as described in connection with the previous embodiments in that upon ignition by the flush/pyrogen igniter 123 the gas generator charge 401, 500 is combusted, the burst disk plugs 125 are ejected at a certain pressure, and the combustion products exhausted through the holes, which may be covered restraints 501, if required by the use of pelletized gas generator charge 500.

Figure 10:
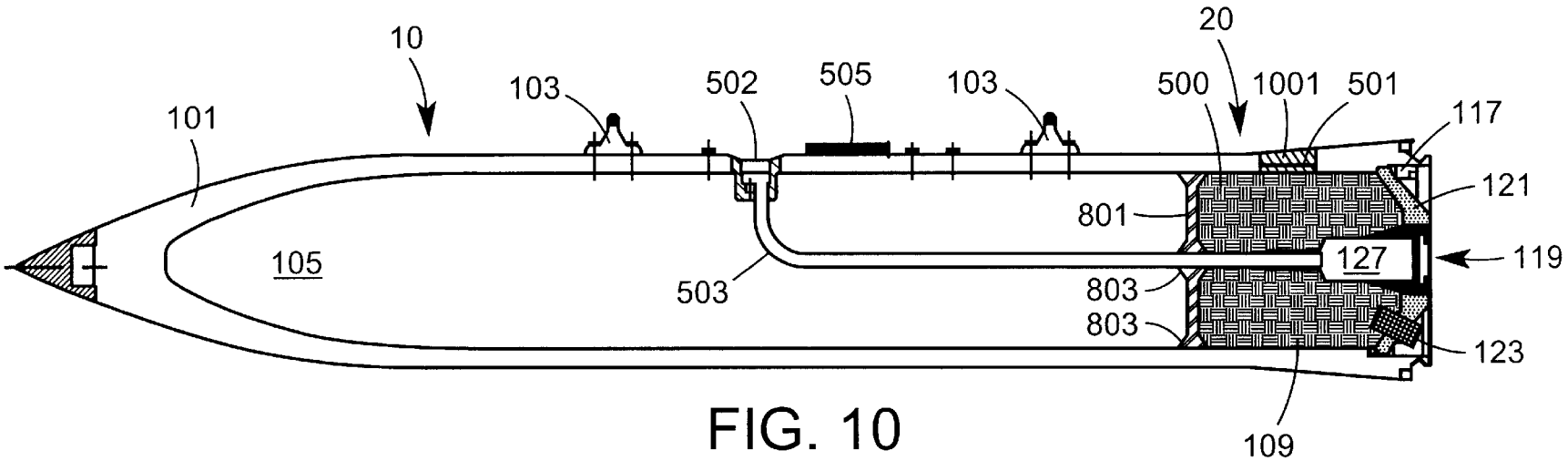
FIG. 10 is a longitudinal cross-sectional view of a warhead according to a further embodiment of the present invention.
Figure 11:
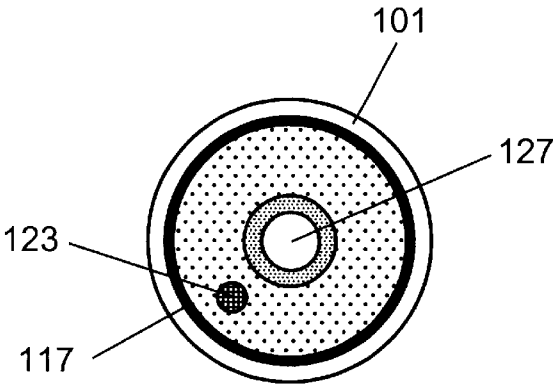
FIG. 11 is an aft view of FIG. 10.

FIG. 10 depicts a device 20 comprising a barrier 801 and compliant gas seals 803 as previously described, wherein the discharge of the combustion products of the device 20 is done sideways through burst disk plugs 1001 positioned at a side location of the warhead casing 101. An appropriate number of plugs 1001 may be spaced about the periphery of the casing wall, the number and size of which may be varied to control operating characteristics of the device 20. FIG. 11 shows the warhead aft closure 119 when the combustion products are vented sideways. In this embodiment, the warhead aft closure 119 is perforated by the receptacle for the charge igniter 123 and by the fuze 127.

The purposes of the sideways venting of combustion products are (a) to improve the warhead-closure 119 structural design simplicity and strength and (b) to provide a sideways thrust to the aft end of the hard target penetrating warhead 10 during device 20 operation. Application of the side thrust just as the hard target penetrating warhead 10 enters a target room may act to turn the hard target penetrating warhead 10 sideways during travel which may restrain it from escaping through a wall or floor of the target as well as present an enlarged profile and increased probability of impacting material or apparatus in the target room. FIG. 10, as shown, employs, as one version of the gas generator charge 401, pellets 500 of combustible gas generant.

Figure 12:
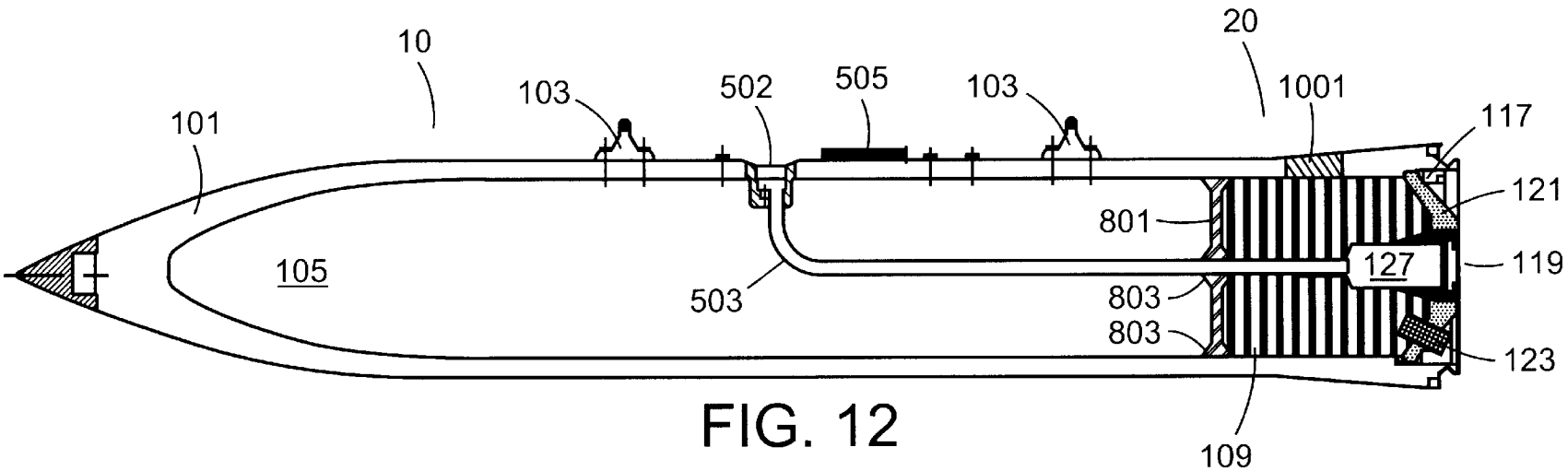
FIG. 12 is a longitudinal cross-sectional view of a warhead according to still a further embodiment of the present invention.
Figure 13:
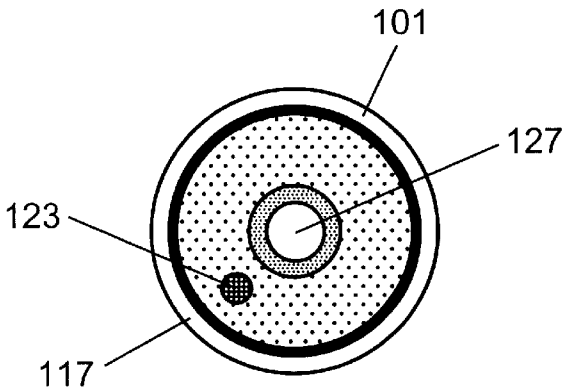
FIG. 13 is an aft view of FIG. 12.

FIG. 12 depicts an alternate embodiment for the gas generating assembly 109 comprising alternating layers of gas generator charge 401 and gas generator support layer 403. The gas generating assembly 109 is made similarly to the gas generating assembly 109 depicted in FIG. 4, except here the gas generating assembly 109 is configured as flat disks stacked normal to the longitudinal axis of the hard target penetrating warhead 10.

Figure 14:
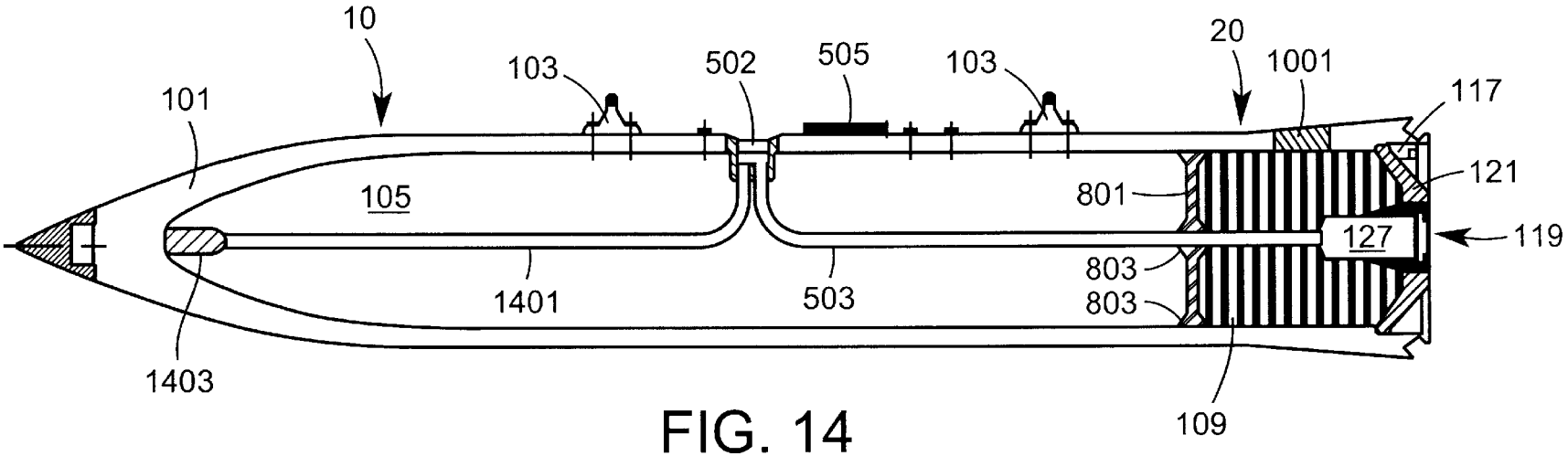
FIG. 14 is a longitudinal cross-sectional view of a warhead according to yet a further embodiment of the present invention.
Figure 15:
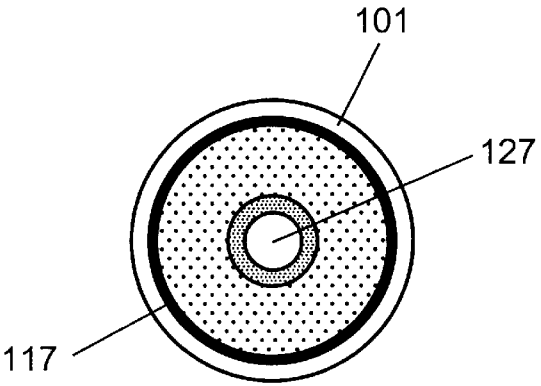
FIG. 15 is an aft view of FIG. 14.

FIG. 14 depicts a device 20 as previously described to which has been added a forward extension of the charging tube 1401 terminating at or near the front end of the main payload area 105 with a flash/pyrogen igniter 1403 which optionally contains a separate gas generant charge.

The purpose of this interior arrangement is to permit an event or ignition signal to be transmitted from the main payload fuze 127 to the forward end of the main payload area 105 via the FZU well 502. The main payload fuze 127 in this instance is designed to actuate upon impact of the hard target penetrating warhead 10 with its target causing fast ignition of the aft gas generator charge 401 and actuation of a pyrotechnic line signal generator that will transmit a signal via the charging tubes 503, 1401 to the forward gas generant charge at 1403. Any suitable linear igniter material may be used, for example zip cord, HiVilite or ITLX. The signal to the forward gas generant charge 1403 may pass through a delay actuator such that the actuation of the forward gas generant charge 1403 occurs some predetermined time delay after actuation of the main payload fuze 127.

Advantages of this embodiment include: a) design simplicity, b) minimum changes to the basic hard target penetrating warhead 10 hardware, and c) built-in flexibility in sequential operation of the device 20 and the contents of the warhead main payload area 105.

The disposition of the gas generator charge 401 in the form of thin cylindrical shapes as shown in FIGS. 1, 4, and 14 is only for purposes of illustration. Any configuration that meets the desideratum of large area of burning ("port") in proportion to vent area will provide the desired functional behavior. For example, the double-sided sheet construction illustrated in FIG. 4 can be fabricated as a single rectangular sheet with a propellant bonded to both sides of a gas generator support layer 403 made from a thin aluminum or steel sheet and the sheet then rolled into a coil and bonded directly to the head end of the gas generator pressure vessel 107 at the gas generator assembly attachment point 113. Similarly, a rectangular sheet as here described may first be corrugated, like the core material in cardboard, and then rolled into a coil.

By way of example, a suitable technique for forming a support-propellant laminate includes utilizing a standard composite rubber-based, ammonium perchlorate and aluminum propellant cut into sheets using a "skiving" cutter, a device that slices or skives a thin sheet from a cylindrical blank of material. The sheets of propellant are spooled off the blank past the skiving knife by turning the blank against the skiving knife. The sheets of propellant, 20 to 100 thousandths of an inch thick are then bonded to either aluminum or stainless steel sheet stock 5–10 mils thick with ordinary epoxy glue. The bonded sheets are then formed into coils, as described above.

Gas generator, propellant or incendiary compositions that favor production of chemical species and the high temperature combustion products that will neutralize biological and/or chemical warfare agents are preferred. High performance rockets are conventionally charged with ammonium perchlorate and aluminum in a polymeric matrix. These propellants produce gas-phase water and hydrogen chloride that combine to form very reactive hot hydrochloric acid; and as the reactants cool the cooled hydrochloric acid remains in the bunker and may act to continue neutralization of bunker contents for many days. The combination of the very high unit heat release from such compositions in combination with the chemical neutralizing potential of the acid have been shown to be very effective in neutralizing biological warfare agents. Thus, incendiary agents based on standard composite rocket propellant technology are logical choices for the application described herein. Other chemicals may be compounded with the propellant or gas generator charge 401, 500 to achieve a greater efficiency in chemical/biological neutralization or a tailored neutralizer for specialized effects; an example is the use of fluorine-containing polymers such as Teflon or Viton materials as a component of the gas generator assembly 109 to produce fluorine compounds in the product gases.

In embodiments utilizing a dedicated gas generator pressure vessel, the gas generator pressure vessel 107 is intended to confine gas pressures from the combusting gas generator charge 401, 500 and to prevent pressure from acting on the payload. Thus, the gas generator vessel 107 must be designed with sufficient strength to contain the operating pressure without rupture: a high strength steel vessel material may be desirable. While massive leakage of combustion gases through the joints at the mating lip 115 and the gas generating assembly threaded attachment 121 is undesirable, leak proof seals are not required, as some minor leakage can be sustained without generator failure during the short operating life of the device 20. For similar reasons, a high temperature nozzle insert or any special nozzle design are unnecessary to prevent erosion of the holes formed by the ejection of the burst disk plugs 125 since the small amount of erosion that occurs during the operating life of the device 20 is inconsequential, based on practical experience with ballistic rockets.

In embodiments utilizing a barrier 801 and compliant gas seals 803, the warhead casing 101 with its warhead aft closure 119 and compliant internal forward barrier 801 and compliant gas seals 803 act to form the gas generator pressure vessel 107. Hard target penetrating warheads 10 to which these designs may be applied all have sufficient mechanical strength to withstand the contemplated operating pressures transmitted through the barrier against the main weapon payload.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. An agent defeat warhead device comprising:

a gas generating assembly;

an igniter; and a plurality of venting ports for the release of gases produced by the gas generator whereby gases released by the gas generating assembly render chemical species which neutralize biological and chemical toxins.

2. The device of claim 1, wherein a gas generating assembly is contained within a pressure vessel shaped as a cylindrical annulus, the material of the pressure vessel of sufficient strength to contain the operating pressure of the gas generating assembly without rupture.

3. The device of claim 2, wherein a hollow center of the annular pressure vessel contains a space for installation of a fuse at a location suitable for initiation of a warhead main payload.

4. The device of claim 2, wherein the pressure vessel further comprises a mating lip.

5. The device of claim 1, wherein a gas generating assembly is contained within a pressure vessel comprised of a warhead casing, a warhead aft closure, a barrier between the gas generator assembly and a main payload, the barrier having a plurality of compliant, floating seals, and a plurality of burst disk plugs sealing a plurality of venting ports.

6. The device of claim 1, wherein a gas generating assembly is further comprised of a plurality of bonded elements of a gas generator charge and a support material, the gas generator charge being of a deflagrating and non-detonable composition, the gas generator charge capable of producing hot gas upon combustion, the gas containing hydrogen chloride and vapor phase moisture, the combination of such agents and chemicals act to neutralize chemical and/or biological agents.

7. The device of claim 6, wherein at least one of the plurality of bonded elements of a gas generator charge and a support material is shaped as a cylinder and disposed concentrically in the annular volume of the gas generating pressure vessel.

8. The device of claim 6, wherein at least one of the plurality of the bonded elements of a gas generator charge and a support material is shaped as a disk and disposed with the radius of the disk normal to the longitudinal axis of the warhead.

9. The device of claim 1, wherein a gas generating assembly is further comprised of pelletized gas generator charge in which substantially all pellets combust independently, the gas generator charge being deflagrating and non-detonable, the gas generator charge producing a hot gas upon combustion, the gas containing hydrogen chloride and vapor phase moisture, the combination of such agents and chemicals act to neutralize chemical and biological agents.

10. The device of claim 1, wherein the agent defeat warhead device is located in an aft end of a warhead casing for the purpose of generating hot gases during penetration of the warhead into a target, said gases being released in and near the hole made in the target by entry of a warhead.

11. The device of claim 10, further comprising a warhead closure for the purpose of securing the agent defeat warhead device into the aft end of the warhead casing.

12. The device of claim 10, wherein an aft closure retaining ring is provided within the aft end of the warhead casing.

13. The device of claim 1, wherein the igniter is one of a flash or pyrogen igniter which initiates the gas generator.

14. The device of claim 1, wherein the plurality of venting ports release gases produced by the gas generating assembly so as to place such gases in and near a hole created in a target by entry of a warhead.

15. The device of claim 14, wherein the plurality of venting ports for the release of gases produced by the gas generating assembly are in the warhead aft closure, thereby allowing venting parallel to the longitudinal axis of a warhead.

16. The warhead of claim 15, wherein each one of the plurality of venting ports, located such as to allow venting parallel to the longitudinal axis of a warhead, are initially blocked by a respective plurality of burst disk plugs designed to obtain an operating pressure within the gas generator of 5,000 to 10,000 pounds per square inch prior to rupturing.

17. The device of claim 14, wherein the plurality of venting ports for the release of gases produced by the gas generating assembly are located in a side of the warhead casing such as to allow venting normal to the longitudinal axis of a warhead.

18. The warhead of claim 17, wherein each one of the plurality of venting ports, located such as to allow venting normal to the longitudinal axis of a warhead, are initially blocked by a respective plurality of burst disk plugs designed to obtain an operating pressure within the gas generator of 5,000 to 10,000 pounds per square inch prior to rupturing.

19. The device of claim 1, further comprising a plurality of restraints, one of each plurality of restraints is disposed across each of the plurality of openings formed by the plurality of venting ports to prevent the release of non-combusted gas generator charge.

20. The device of claim 1, wherein the gases produced by the gas generator are released so as to neutralize chemical and biological toxins before they can escape from a bunkered target.

* * * * *